United States Patent [19]

Lemmer

[11] Patent Number: 4,691,978

[45] Date of Patent: Sep. 8, 1987

[54] CIRCUIT BREAKER, IN PARTICULAR AN ACCESSORY OR MOTOR CONTACTOR

[75] Inventor: Helmut Lemmer, Marienheide-Kalsbach, Fed. Rep. of Germany

[73] Assignee: Square D Starkstrom GmbH, Fed. Rep. of Germany

[21] Appl. No.: 838,251

[22] Filed: Mar. 10, 1986

[30] Foreign Application Priority Data

Apr. 15, 1985 [EP] European Pat. Off. ..... 85 10 4537.7

[51] Int. Cl.[4] ..... H01R 13/70

[52] U.S. Cl. ..... 439/620; 200/51 R

[58] Field of Search ..... 200/51 R; 339/147 R, 339/147 P

[56] References Cited

U.S. PATENT DOCUMENTS 3,465,280 9/1969 Paganelli ..... 339/147 P

FOREIGN PATENT DOCUMENTS 7342273 6/1975 Fed. Rep. of Germany .

8236682 6/1983 Fed. Rep. of Germany .

879375 10/1961 United Kingdom ..... 200/51 R

OTHER PUBLICATIONS

Herbert Franken, Schütze and Schützensteuerungen, 1967, pp. 347–348 (German).

*Primary Examiner*—Gil Weidenfeld

*Assistant Examiner*—Gary F. Paumen

*Attorney, Agent, or Firm*—Diller, Ramik & Wight

[57] ABSTRACT

A circuit breaker including a housing, coil connector screws and associated connection rails within the housing, a module in a casing received in a recess of the housing, the module being adapted to limit or attenuate voltage peaks, the module having electrical connectors for electrically connecting the module to the connection rails otherwise than through the coil connector screws, the electrical connectors being a pair of metallic leaf springs each in contact with one of the connection rails, the case being of a generally rectangular configuration with a corner recess at two corners thereof, and each corner recess mating with a projection of the housing and being snap-connected thereto.

17 Claims, 6 Drawing Figures

FIG.1
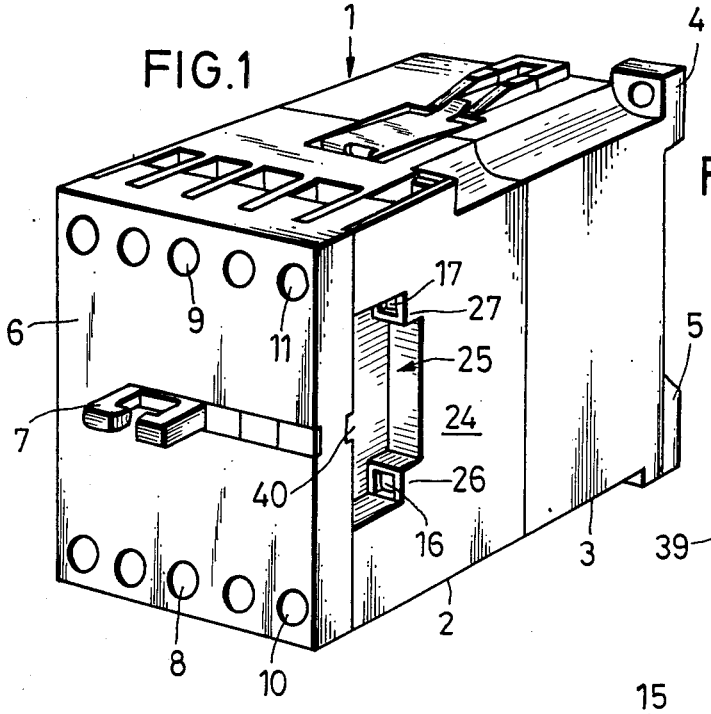
FIG.2
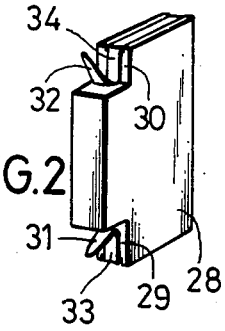
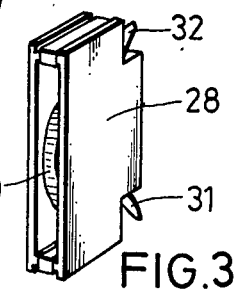
FIG.3
FIG.4
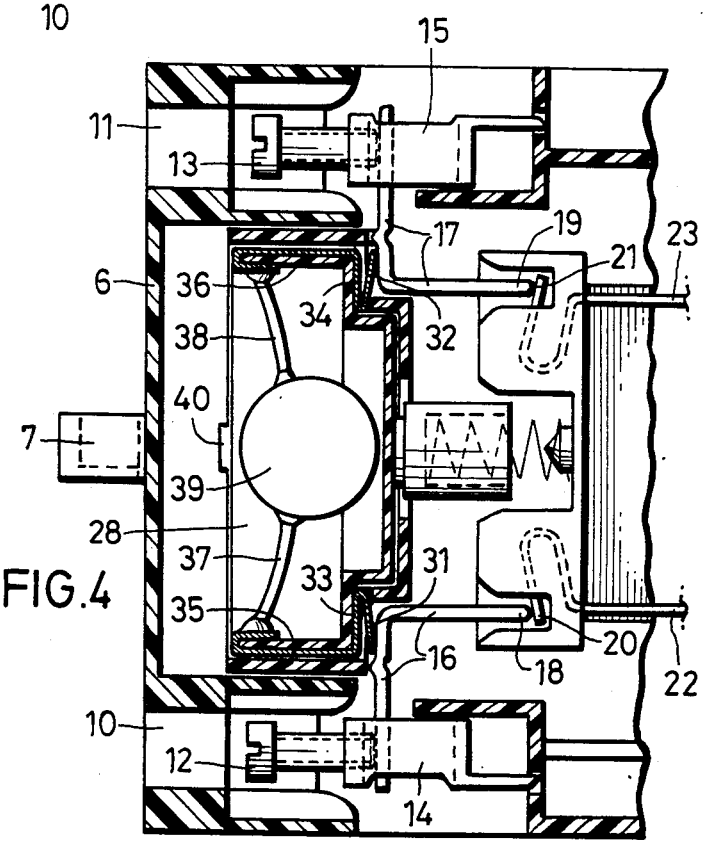

CIRCUIT BREAKER, IN PARTICULAR AN ACCESSORY OR MOTOR CONTACTOR

BACKGROUND OF THE INVENTION

This invention relates to a novel circuit breaker, and particularly an accessory contactor or a motor contactor which includes a module to limit or attenuate voltage peaks. The module is carried in a plastic casing which is housed in a recess of the circuit breaker housing side wall and is in electrical conduction with connecting rails of the contactor without being connected thereto in any fashion through the conventional coil connector screws.

The contactors of the type to which this invention is directed are known and are made in various shapes, sizes and designs. A distinction is made between AC-actuated and DC-actuated contactors. In order to attenuate voltage peaks generated when AC-actuated contactors are turned "OFF", and which may rise to a multiple of the rated actuated potential, it is normal to use RC modules (R and C denoting resistance and capacitance, respectively). In order to limit voltage peaks generated when turning "ON" DC-actuated contactors which may also reach a multiple of the rated actuation potential, attenuating modules are used, such as diode modules or varistor modules. The electric components of the modules are preferably cast in plastic and/or mounted in a separate case or casing defining a relatively small component of the overall circuit breaker. Common to all such modules is the fact that they are normally mounted on an outer end surface of the cover of a particular contactor/circuit breaker, and in most cases the modules include a foot which is inserted into an aperture of the contactor cover. Two flexible hook-up leads of varying length extend from each module to permit the module to be connected to the contactor coil. The latter is accomplished by connecting the hook-up leads of the module to the conventional coil connector screws and the associated coil terminals by being inserted into connection rail clamps against which the connector screws bear. In practice, serious difficulties are encountered by this arrangement because the connection rails or terminal clamps already include ordinary leads and is difficult/cumbersome to additionally connect thereto the hook-up leads of the module. Furthermore, because of the latter difficulty it is not infrequent for the module hook-up leads to become disconnected or to malfunction.

As regards DC-actuated contactors, there are difficulties if the hook-up leads of the module are interchanged with respect to the negative and positive terminals. Furthermore, aside from the unsightliness of the hook-up leads dangling from the contactor cover, the main drawback of this arrangement is the extra bulk created by mounting the modules atop the contactor covers. The latter requires that the module together with the hook-up leads and the coil terminal clamps be disassembled, and ultimately reassembled or refastened once again, at any time that the module must be changed, removed, or the contactor cover opened or closed relative to its housing. All of this is relatively cumbersome and leads to unreliability and product malfunctions.

SUMMARY OF THE INVENTION

In view of the foregoing, it is a primary object of the present invention to provide a novel circuit breaker or contactor which permits easy connection of a module thereto without dangling hook-up leads, extraneous additive pieces which enlarge the overall peripheral shape and size of the contactor and without incurring any problems during conversion or retrofitting.

The latter object of the invention is resolved by providing a module whose electrical terminals are so connected to the connection rails of the contactor that the coil connector screws thereof are solely used to clamp conventional connections thereto. Hence, since the coil connector screws having nothing to do with the module hook-up or the leads of the latter, malfunctions that have occurred in the past are totally eliminated.

In the present case the coil connecting screws are simply used to connect conventional connectors to the connection rails through the associated clamps whereas the modules are connected to the connection rails totally separately and distinct from the connecting screws and associated clamps. The latter not only eliminates malfunctions and miswiring, but the labor of wiring up the dangling electrical leads of conventional leads of conventional modules is totally eliminated.

In a particularly advantageous embodiment of the invention, a side wall of the contactor housing is preferably provided with a recess having a configuration corresponding to that of a casing in which the module is held captive. Thus, the casing is readily inserted into the contactor housing recess, and the module of the casing is placed into electrical conductivity with the contactor connection rails through spring leads without in any fashion utilizing the conventional terminal screws and clamps of the contactor/circuit breaker.

With the above and other objects in view that will hereinafter appear, the nature of the invention will be more clearly understood by reference to the following detailed description, the appended claims and the several views illustrated in the accompanying drawings:

BRIEF DESCRIPTION OF THE DRAWINGS

FIG. 1 is a perspective view of a novel contactor constructed in accordance with this invention, and illustrates a recess in the side wall for receiving a casing of a module.

FIG. 2 is perspective view of a casing, and illustrates a pair of spring connectors of the associated module.

FIG. 3 is another perspective view of the opposite side of the casing of FIG. 2, and illustrates the module therein.

FIG. 4 is a fragmentary longitudinal sectional view of the contactor of FIG. 1, and illustrates the manner in which the casing is housed within the contactor housing with its spring leads in the electrical conductivity with the connection rails of the contactor separate and apart from the conventional contactor connecting screws and associated clamps.

DESCRIPTION OF THE PREFERRED EMBODIMENT

Figure 5:
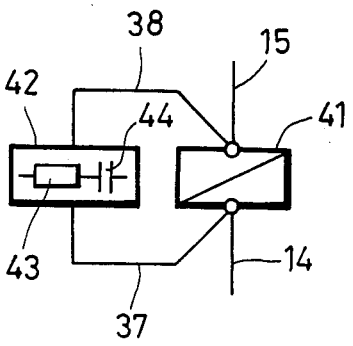
FIG. 5 is a simplified electrical circuit of an RC module in parallel with a contactor coil.

Reference is now made to the drawings, particularly FIGS. 1 and 4 which illustrate a contactor/circuit breaker 1 which is formed in a conventional manner of two housing portions or parts 2, 3 collectively defining a housing having feet 4 and 5 or similar fastening means for assembling the contactor 1 to a base plate, support rail or the like. The contactor 1 includes a conventional contactor magnetic system (not shown) located in the housing portion 3 while a conventional system of contacts is located within the housing portion 2. The latter do not form part of this invention and, hence, are not illustrated. The cover 6 closes an end face (unnumbered) of the contactor 1 and carries a hook 7 to which are secured push-buttons or similar actuation members. Other additional contact units may also be fastened to the cover 6, and these additional units are connected to the hook 7 for operating the internal mechanisms thereof, all of which is once again unillustrated because the same is not pertinent to the present invention.

Two mutually opposite rows of bores 8, 9 are provided in the cover 6 to permit insertion thereinto of a screwdriver for operating connector screws of which only screws 12 and 13 associated with bores 10, 11 (FIG. 4) are shown. The external bores 10, 11 function to permit the coil connector screws 12, 13 to be manipulated by a screwdriver so that external electrical leads can be clamped to the respective connection rails 16, 17 through associated clamps 14, 15. For example, a connector lead is inserted between the end of the screw 12 and the connector rail 16 within the clamp 14 and the screw 12 is tightened to rigidify this connection. The latter is exemplary of conventional hook-up leads through openings (unnumbered) of the housing part 2. In this fashion the connection rails 16, 17 are solidly connected on the one hand to the clamps or coil terminals 14, 15 and are thereby rigidly fixed in the housing 2, 3; whereas on the other hand the ends 18, 19 of the connection rails 16, 17 are electrically connected to spring clips 20, 21 which are in turn electrically connected through hook-up leads 22, 23, respectively, to the contactor coil (not shown).

A clearance, slot or recess 25 is provided in a side wall 24 of the housing part or portion 2. The recess 25 receives a casing 28 of like shape which houses therein a module 39. The module 39 includes electrical terminals serially denoted by the reference numerals 31, 33, 35, 37 and 32, 34, 36, 38. The latter electrical terminals are respectively directly connected to the connection rails 16 and 17, as is most apparent from FIG. 4 of the drawings.

The casing 28 is preferably constructed from plastic material and is generally of a shallow T-shaped configuration corresponding to the general shallow T-shaped configuration of the recess 25 (FIG. 1). The casing 28 includes generally square recesses 29, 30 at two corners (unnumbered) of the casing 28 through openings (unnumbered) of which project the terminal end or end portions 31, 32 (FIGS. 2 through 4) of the electrical terminals 31-37 and 32-38, respectively. The terminal ends 31, 32 project through openings (unnumbered) of the square projections 26, 27 when the casing 28 is received in the recess 25, thus placing the terminal ends 31, 32 into electroconductivity with the connection rails 16, 17, respectively, (FIG. 4) without in any fashion utilizing the screws 12, 13 or the respective clamps 14, 15.

The electrical terminals 31–37 and 32–38 are preferably constructed from metallic leaf-spring material, and the ends 31, 32 are preferably bent upon the next adjacent portions 33, 34 (FIG. 4) to define an acute angle. The ends 31, 32 are bent inward when the casing 28 is inserted into the recess 25, thus placing the ends 31, 32 into spring-bearing engagement with respective connection rails 16, 17. The latter not only maintains a firm electrical connection between the ends 31, 32 and the connection rails 16, 17, but also holds the casing 28 within the recess 25. In addition, the casing 28 and recess 25 may be provided with snap-fit tongue and groove connections which define snap-connections (not shown) to additionally hold the casing 28 within the recess 25. Such may be small projections, ribs or grooves in the recess 25 or casing 28 mating with like projections, ribs or grooves of the casing 28 and the recess 25.

A depression or slot 40 is also provided in the cover 6 (FIGS. 1 and 4) near an edge thereof to allow an insertion of a screwdriver so that the casing 28 may be pried from the recess 25. This makes it relatively simple to remove one module and reinsert another module within the recess 25. In such cases where the contactor 1 must operate without the module 39, a dummy casing may simply be inserted into the clearance 25 to close the recess 25 without creating any electrical contact with the connection rails 16, 17.

Figure 6:
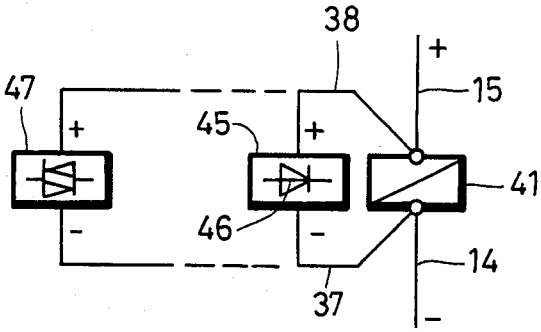
FIG. 6 is a simplified circuit of a diode module or a varistor module in parallel with the contactor coil.

In further accordance with this invention, the recess 25 and/or the casing 28 are so shaped or identified as to prevent rotational mismatch during insertion of any casing 28 into an associated recess 25. The latter is particularly important in DC-actuated contactors where the positive and negative polarities must be absolutely observed. In this case, the invention further provides that the outer surface (unnumbered) of the case or casing 28 be marked in color or script or through circuit design to denote an RC module 42 (FIG. 5) or a diode module 45 (Figure 6) or a varistor module 47 (FIG. 6). Referring specifically to FIG. 5, the latter illustrates a simplified circuit diagram formed on the outside surface of the casing 28 which includes a coil 41 of an AC-actuated contactor with the conventional connectors or coil terminals 14 and 15 shown as in FIG. 4. The surface of the casing 28 may also have formed thereon the module terminals or leads 37 and 38 connected to a resistor 43 and a capacitor 44. Thus, with the indicia shown in FIG. 5 on the exterior surface of the casing 28, the same will be inserted into the recess 25 only with this indicia visible and, thus, the terminal ends 31, 32 will indeed contact the desired connection rails 16, 17 and the associated clamps 14, 15

In FIG. 6 there is illustrated a simplified circuit of a coil of a DC-actuated contactor in parallel with a diode module 45 and an associated diode 46. In lieu of the latter two components, the indicia might include a varistor module 47, again imprinted or otherwise positioned upon the intended external surface of the casing 28. Due to the existence of the leads 14, 15 thereon, the casing 28 can but be inserted in the recess 25 in its proper positive/negative mode.

Although a preferred embodiment of the invention has been specifically illustrated and described herein, it is to be understood that minor variations may be made in the apparatus without departing from the spirit and scope of the invention, as defined in the appended claims.

I claim:

1. A circuit breaker comprising a housing, coil connector screws and associated connection rails carried by said housing, a module associated with said housing and being adapted to limit or attenuate voltage peaks, said module having electrical connector means for electrically connecting said module to said connection rails otherwise than through said coil connector screw, and said electrical connector means include a pair of metallic leaf springs each in contact with one of said connection rails.

2. The circuit breaker as defined in claim 1 wherein said housing includes a side wall, a recess in said side wall, and said module being housed in said recess.

3. The circuit breaker as defined in claim 1 wherein said housing includes a side wall, a recess in said side wall, said module being housed in a case having a configuration corresponding to said recess, and said case having an outer surface generally flush with an outer surface of said side wall.

4. The circuit breaker as defined in claim 1 wherein each of said leaf springs includes a pair of legs at an acute angle.

5. The circuit breaker as defined in claim 1 wherein said housing includes a side wall, a recess in said side wall, said module being housed in a case having a configuration corresponding to said recess, said case being snap-fit into said recess, and said plastic case and recess having at least one cooperative snap-fit tongue and groove connection.

6. The circuit breaker as defined in claim 1 wherein said housing includes a side wall, a recess in said side wall, said module being housed in a case having a configuration corresponding to said recess, said case having an outer surface generally flush with an outer surface of said side wall, and a depression between said housing side wall and case for receiving a tool to pry said case from said recess.

7. The circuit breaker as defined in claim 1 including means for preventing inadvertent rotational inversion insertion of said module into said housing.

8. The circuit breaker as defined in claim 1 including means for preventing inadvertent rotational inversion insertion of said module into said housing, and said preventing means is indicia upon said module indicative of at least one of an RC module, a diode module or a varistor module.

9. A circuit breaker comprising a housing, coil connector screws and associated connection rails carried by said housing, a module associated with said housing and being adapted to limit or attenuate voltage peaks, said module having electrical connector means for electrically connecting said module to said connection rails otherwise than through said coil connector screws, said housing includes a side wall, a recess in said side wall, said module being housed in a case having a configuration corresponding to said recess, said case having an outer surface generally flush with an outer surface of said side wall, said case is generally of a rectangular configuration, a corner recess at each of two corners of said rectangular case, said electrical connector means include a metallic contact at each corner recess in contact with an associated connection rail, said side wall recess being matchingly contoured to said case configuration, and said side wall recess having two projections matingly received in said corner recess.

10. The circuit breaker as defined in claim 9 including an opening in each of said two projections through which pass said metallic contacts for contacting each associated connection rail therethrough.

11. The circuit breaker as defined in claim 9 wherein each metallic contact is a spring.

12. The circuit breaker as defined in claim 9 wherein each metallic contact is a leaf spring.

13. The circuit breaker as defined in claim 10 wherein each metallic contact is a spring.

14. The circuit breaker as defined in claim 10 wherein each metallic contact is a leaf spring.

15. A circuit breaker comprising a housing, coil connector screws and associated connection rails carried by said housing, a module associated with said housing and being adapted to limit or attenuate voltage peaks, said module having electrical connector means for electrically connecting said module to said connection rails otherwise than through said coil connector screws, said housing includes a side wall, a recess in said side wall, said module being housed in a case having a configuration corresponding to said recess, said case having an outer surface generally flush with an outer surface of said side wall, said case is generally of a rectangular configuration, a corner recess at each of two corners of said rectangular case, said electrical connector means include a metallic spring portion at each corner recess in contact with an associated connection rail, said side wall recess being matchingly contoured to said case configuration, said side wall recess having two projections matingly received in said corner recesses, said two projections having openings exposing said connection rails therethrough, and said spring portions contact said connection rails through said openings.

16. A circuit breaker comprising a housing, connector screws and associated connection rails carried by said housing for connecting electrically conducting coil leads to said connection rails, a separate module carried by said housing, said module carrying electric circuit means for limiting or attenuating voltage peaks, two electrical contacts of said electric circuit means being connected one each to each of said connection rails, contact means for connecting each of said electrical contacts to its associated connection rail other than by said connector screws, and said contact means each being a metallic contact projecting from said module through an associated opening in said housing into electric contact with an associated one of each of said connection rails.

17. The circuit breaker as defined in claim 16 wherein each metallic contact is a leaf spring.

* * * * *